US010166757B2

(12) United States Patent
Rogge et al.

(10) Patent No.: US 10,166,757 B2
(45) Date of Patent: Jan. 1, 2019

(54) INKING UNIT OF A PRINTING MACHINE

(71) Applicant: Windmoeller & Hoelscher KG, Lenerich (DE)

(72) Inventors: Uwe Rogge, Lengerich (DE); Robert Blom, Tecklenburg (DE); Frank Gunschera, Osnabrueck (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 0 days.

(21) Appl. No.: 14/840,465

(22) Filed: Aug. 31, 2015

(65) Prior Publication Data

US 2016/0114571 A1 Apr. 28, 2016

Related U.S. Application Data

(63) Continuation of application No. 12/737,401, filed as application No. PCT/EP2009/004933 on Jul. 8, 2009, now Pat. No. 9,156,244.

(30) Foreign Application Priority Data

Jul. 10, 2008 (DE) ..... 10 2008 040 328

(51) Int. Cl.

| | |
|---|---|
| ***B41F 31/00*** | (2006.01) |
| ***B41F 31/26*** | (2006.01) |
| ***B41F 5/24*** | (2006.01) |

(52) U.S. Cl.

CPC ..... *B41F 31/004* (2013.01); *B41F 5/24* (2013.01); *B41F 31/26* (2013.01); *B41P 2227/21* (2013.01)

(58) Field of Classification Search

CPC .. B41F 5/24; B41F 13/30; B41F 27/00; B41F 31/26; B41P 2227/20; B41P 2227/21; B41P 2213/802; B41P 2213/80

See application file for complete search history.

(56) References Cited

U.S. PATENT DOCUMENTS 4,481,882 A 11/1984 Rudolph
5,862,828 A * 1/1999 Dorfler ..... F15B 11/15 137/106

(Continued)

FOREIGN PATENT DOCUMENTS

| | | |
|---|---|---|
| DE | 10220608 | 11/2003 |
| EP | 1090754 | 8/2003 |

(Continued)

*Primary Examiner* — Jennifer Simmons

*Assistant Examiner* — Leo T Hinze

(74) *Attorney, Agent, or Firm* — Jacobson Holman, PLLC.

(57) ABSTRACT

An inking system of a printing press includes an impression cylinder for guiding a printing substrate, and at least one ink-transfer roller. The ink-transfer roller includes a cylinder mandrel, on which at least one cylinder sleeve is concentrically displaceable, and bearing blocks, in which ends of the ink-transfer roller are mounted and which are independently displaceable in the radial direction of the impression cylinder. The ink-transfer roller can be set against the impression cylinder or any other ink-transfer roller, with a bearing block being detachable from one end of the ink-transfer roller and displaceable relative to the ink-transfer roller so that the cylinder sleeve can be removed via this one end. A stop device, with which the cylinder sleeve can be brought into contact, has components that are movable in the axial direction of the print roller. The movable stop device components can be decelerated via a force-providing element.

11 Claims, 5 Drawing Sheets

(56) References Cited

U.S. PATENT DOCUMENTS

| | | | | |
|---|---|---|---|---|
| 6,142,073 | A * | 11/2000 | Zeman | B41F 5/24 101/216 |
| 6,492,858 | B1 | 12/2002 | Shiromaru et al. | |
| 6,526,885 | B2 | 3/2003 | Walczak et al. | |
| 6,615,716 | B1 | 9/2003 | Freddo et al. | |
| 6,691,614 | B2 * | 2/2004 | Bell | B41F 13/10 101/375 |
| 6,792,858 | B2 * | 9/2004 | Kolbe | B41F 27/105 101/375 |
| 7,225,736 | B2 | 6/2007 | Blom et al. | |
| 7,331,288 | B2 * | 2/2008 | Gottling | B41C 1/05 101/216 |
| 7,762,187 | B2 * | 7/2010 | Petri | B41F 27/105 101/375 |
| 7,765,187 | B2 | 7/2010 | Bergant et al. | |
| 9,156,244 | B2 * | 10/2015 | Rogge | B41F 5/24 |
| 2004/0045463 | A1 | 3/2004 | Pertile | |
| 2006/0096478 | A1 * | 5/2006 | Marchini | B41F 27/105 101/375 |

FOREIGN PATENT DOCUMENTS

| | | | |
|---|---|---|---|
| EP | 1745929 | 1/2007 | |
| WO | WO 2006/048907 | 5/2006 | |
| WO | WO 2006048907 A1 * | 5/2006 | B41F 27/105 |

* cited by examiner

INKING UNIT OF A PRINTING MACHINE

CROSS-REFERENCE TO RELATED APPLICATIONS

This application is a continuation application of U.S. application Ser. No. 12/737,401, filed Mar. 11, 2011, now U.S. Pat. No. 9,156,244, the disclosure of which is incorporated by reference as is fully set forth herein. The aforementioned U.S. application Ser. No. 12/737,401 is a nationalization of PCT/EP09/04933, filed Jul. 8, 2009.

BACKGROUND ON THE INVENTION

1. Field of Invention

The invention relates to an inking system of a printing press having an impression cylinder for guiding a printint substrate, at least one ink-transfer roller comprising a cylinder mandrel, on which at least one cylinder sleeve is concentrically displaceable, and bearing blocks, in which ends of the ink-transfer roller are mounted and which are displaceable independently of each other relative to the impression cylinder so that the ink-transfer roller can be set against the impression cylinder or any other ink-transfer roller, with a bearing block being detachable from one end of the ink-transfer roller and displaceable relative to the ink-transfer roller so that the at least one cylinder sleeve can be removed by way of the aforementioned one end. The invention also relates to a method of sliding a cylinder sleeve onto an ink-transfer roller that employs the elements of the above-described system.

2. Description of the Prior Art

It is frequently necessary to change ink-transfer rollers of one or more inking systems for carrying out print jobs. The document DE 102 20 608 C1 describes this process in detail, for example. The process in question relates primarily to print rollers that carry the print motif while other ink-transfer rollers, for example, anilox rollers, can frequently remain in the printing press. An inking system serves to print a motif by the use of a single ink. In different printing presses, an impression cylinder guiding the printing substrate can be assigned to each inking system. In other printing presses, it is possible to arrange a plurality of inking systems around a single impression cylinder. In this case, the printing substrate that is then usually present in the form of a web need not leave the impression cylinder, which is of advantage when printing plastic webs, for example. Such printing presses are often referred to as central cylinder printing presses and are primarily used in the field of package printing. The preferred printing process for this purpose is flexographic printing.

In order to simplify and thus accelerate the process of setting up the printing press for the next job, the ink-transfer rollers are often provided with a multipart construction. A first part is the cylinder mandrel that remains in the printing press. One or more cylinder sleeves can now be slid onto this cylinder mandrel, the outer sleeve carrying a functional element. That is to say, the printing-cylinder sleeve carries the printing plate. All the inner sleeves serve only for adapting the diameter of the roller and thus the printing length and are therefore referred to as adapter sleeves. The inner sleeves are often limited to one sleeve at most for reasons of stability.

For changing the cylinder sleeves, the cylinder mandrel that is otherwise mounted at both ends thereof in bearing blocks that are displaceable relative to the frame of the printing press or the impression cylinder is exposed at one end thereof. For this purpose, the cylinder mandrel is detached from the bearing block in question. This bearing block is then displaced relative to the cylinder mandrel so that one or more sleeves can now be pulled off by way of this free end in the axial direction of the ink-transfer roller and new sleeves can be slid onto the same.

For defining the axial position of a sleeve on the cylinder mandrel, the latter often comprises a stationary ring, against which the cylinder sleeve is slid. In doing so, the cylinder sleeve often violently strikes against the ring so that this results in damage to cylinder sleeves or cylinder mandrels in the long term, more particularly when the cylinder sleeves are adapter sleeves that are heavy, in part.

SUMMARY OF THE INVENTION

It is therefore an object of the present invention to suggest an inking system, in which damage of such type is prevented. This object is achieved with an inking system having a stop device, with which the cylinder sleeve can be brought into contact, with components of the stop device being movable in the axial direction of the print roller, and the components of the stop device being decelerated in their movement via force-providing element.

Accordingly, a stop device is provided, with which the cylinder sleeve can be brought into contact, components of the stop device being movable in the axial direction of the print roller. Furthermore, provision is made according to the invention for decelerating the components of the stop device during their movement by means of a force-providing element.

The invention thus performs the following function: When a cylinder sleeve is slid onto the cylinder mandrel, the former strikes against components of the stop device before striking against the stationary ring of the cylinder mandrel. Since the components of the stop device are movable in the axial direction, they are set in motion by the cylinder sleeve. But this movement can be decelerated by means of the force-providing element. It is thus possible to decelerate the movement of the cylinder sleeve, in particular so that it strikes against the stationary ring at the lowest speed possible. Damage to the cylinder sleeve and/or cylinder mandrel is prevented in this way.

In an advantageous embodiment, the force-providing element comprises a spring element that is preferably supported against the bearing block and/or the frame of the printing press. The spring force for this purpose should be selected such that it does not increase to an excessive level when the cylinder sleeve strikes against the stationary ring since otherwise the cylinder sleeve is again accelerated in the opposite direction.

In a further embodiment, provision is made for the force-providing element to comprise a pressurizing-medium cylinder comprising at least one pressure chamber that can be subjected to positive or negative pressure. It is preferred to provide positive pressure since compressed air is usually used in printing presses. However, a resilient effect can also be observed in this embodiment. This means that the force provided increases with the distance covered.

In order to prevent the aforementioned effect, provision is preferably made to reduce the counteracting force supplied by the force-providing element during the movement. If a spring element is used, this means that the support of the spring element must be displaceable.

In a preferred embodiment, however, the pressure chamber of the pressurizing-medium cylinder is provided with a supply and/or discharge line, by means of which a pressurizing medium, preferably compressed air, can be supplied or discharged. Furthermore, a throttle element is provided in this supply and/or discharge line, by means of which throttle element the flow velocity of the pressurizing medium can be reduced within parts of the supply and/or discharge line. In this embodiment, the pressurizing medium is thus not constantly compressed or relieved to an increasing degree so that there is no increasing force exerted. Rather, the pressurizing medium flows through the supply and/or discharge line out of the pressure chamber or into the same. In doing so, the pressurizing medium also flows through a throttle element so that the pressurizing medium indeed exists in a compressed or relieved state, but the pressure prevailing inside the pressure chamber, as far as possible, hardly changes. In this way, it is possible to decelerate the printing sleeve by the use of a constant force as far as possible. This results in a constant deceleration. It is advantageous if the throttle element comprises an adjusting device, by means of which the flow velocity can be controlled so that the stop device can be adapted in terms of its decelerating action to suit the weight of the sleeve used.

Furthermore, it is very advantageous if the stop device can be set against the front side of the cylinder sleeve or removed therefrom by means of the pressurizing-medium cylinder so that the stop device does not remain in contact with said front side during the rotation of the ink-transfer roller.

It is also advantageous if the stop device is equipped with a compressed-air supply line and a compressed-air outlet, the compressed-air outlet being connectable to a compressed-air supply opening of the cylinder sleeve. In this way, the stop device can be used to apply compressed air to a so-called adapter sleeve so that the sleeve surrounding this adapter sleeve can be pulled off easily by the use of a small force. If the stop device does not have this configuration, then a separate compressed-air supply device would have to be provided for the cylinder sleeve in the printing press described. It is thus possible by means of the embodiment of the invention described to cut down on installation space.

An exemplary embodiment of the invention is revealed in the following description and the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
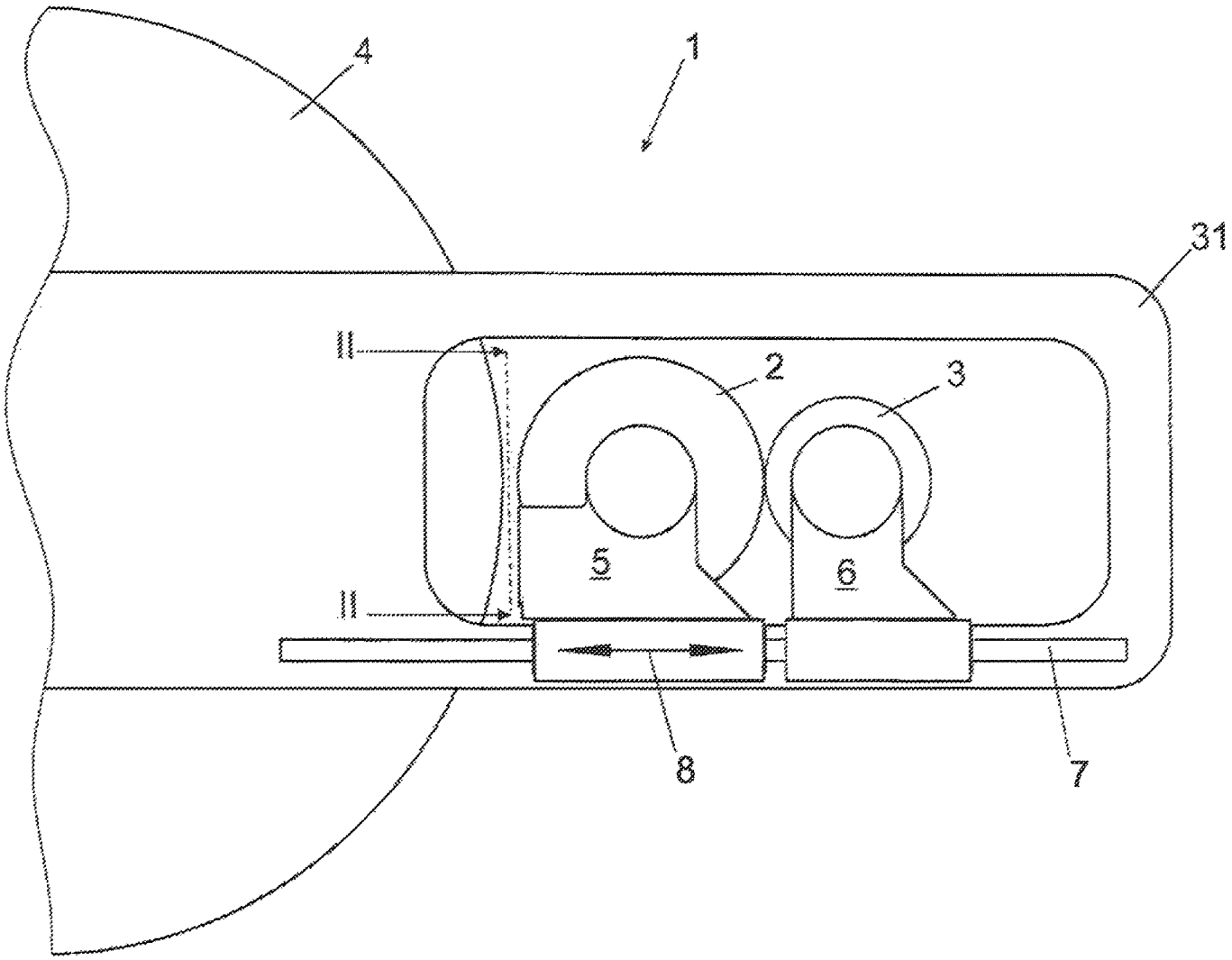
FIG. 1 is a side view of a portion of a printing press.

FIG. 1 is a side-view of an inking system 1 of a printing press. This inking system 1 comprises a print roller 2 and an anilox roller 3. The print roller 2 can be set against the impression cylinder 4, on which the printing substrate (not shown in the figure) travels. The anilox roller 3 can, in turn, be set against the print roller 2. The two rollers 2 and 3 are mounted by means of their respective two ends in bearing blocks, of which only the front bearing blocks are shown. The bearing block 5 is thus assigned to the print roller 2. The bearing block 6 is assigned to the anilox roller 3. In order to move the rollers so as to set them against and remove them from each other, the bearing blocks 5 and 6 are displaceable along the rail 7 in the direction of the double arrow 8. Similarly, the rear bearing blocks (not shown in the figure) are also displaceable along a rail. The displacement is carried out by means of suitable drive systems that are known per se and are not described here in detail.

Both the print roller 2 and the anilox roller 3 are composed of a cylinder mandrel and one or more cylinder sleeves (not shown in detail in FIG. 1). In order to be able to change the cylinder sleeves, the bearings that support the ends of the mandrels can be removed from the same. The bearing blocks 5 and 6 can then be moved aside. The cylinder mandrels are now held only by the rear bearing blocks. This unilateral bearing is also referred to as "cantilever support." The sleeves can now be removed from the mandrels and replaced with new ones.

Figure 2:
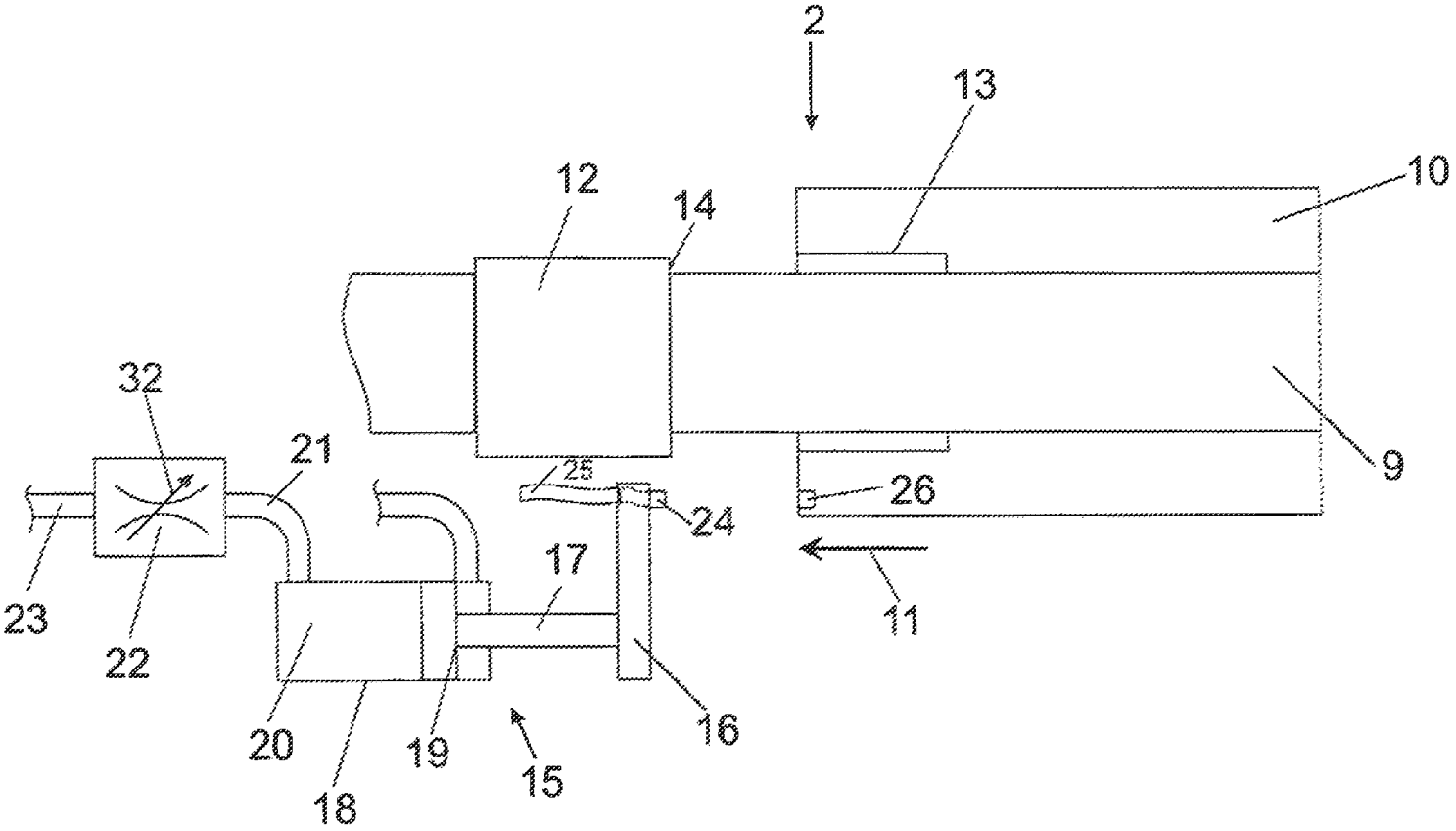
FIG. 2 shows a view taken along line II-II marked in FIG. 1.

FIG. 2 shows a view taken along line II-II marked in FIG. 1. The construction of the print roller 2 comprising a cylinder mandrel 9 and a cylinder sleeve 10 is evident from this figure. This figure shows the print roller 2 while the cylinder sleeve 10 is being slid onto the same. The cylinder sleeve 10 usually has an inside diameter that is slightly smaller than the outside diameter of the cylinder mandrel 9. The inner surface of the cylinder sleeve, however, is made of a compressible material so that compressed air flowing from small openings of the cylinder mandrel 9 expands the inside diameter of the cylinder sleeve 10 to such an extent that it is possible to easily slide the cylinder sleeve 10 onto the print roller. In doing so, the cylinder sleeve 10 slides properly on an air cushion. The cylinder sleeve can now be slid onto the print roller in the direction of the arrow 11. In other printing presses, it is possible to use cylinder sleeves 10, of which the inside diameter is larger than the outside diameter of the cylinder mandrel. In this case, such a sleeve 10 can also be slid onto the print roller without the use of any air cushion. When the sleeve has reached the axial position intended, it can be locked into position, for example, by means of so-called tensile-stress elements. A tensile-stress element can be a section of the cylinder mandrel 9, which section has an outside diameter that can be enlarged, for example, by a hydraulic force acting from within in order to thus lock the cylinder sleeve in position. The regions of the cylinder sleeve 10, on which such tensile-stress elements act, should not be compressible.

The cylinder mandrel 9 comprises, on one side thereof, a section that has an enlarged diameter and that can be in the form of a ring 12. The ring 12 and the cylinder mandrel 9 can be connected to each other permanently or formed integrally. This ring 12 serves for defining the axial position of the cylinder sleeve 10. In other words, the cylinder sleeve 10 is slid until it strikes against the ring. The cylinder sleeve 10 can, as shown in FIG. 2, comprise a section 13, in which the inside diameter is enlarged. This section 13 can then encompass the ring. The front side 14 of the ring thus serves as a stop surface for the cylinder sleeve 10. Since the air cushion described above enables the sleeve 10 to be slid smoothly onto the mandrel 9 in the axial direction shown by the arrow 11, the sleeve 10 can be slid at a relatively high speed against the ring so that the possibility of damage cannot be ruled out.

In order to reduce the possibility of damage, it is advantageous to decelerate the cylinder sleeve 10 before it impinges on the ring. For this purpose, a stop device 15 is provided according to the invention. The latter comprises a stop 16 attached to the piston rod 17 of a pressurizing-medium cylinder 18. A reciprocating piston 19, to which the piston rod 17 is attached, is disposed inside the pressurizing-medium cylinder 18. In FIG. 2, the first chamber 20 that is delimited by that side of the reciprocating piston 19 that is oriented away from the piston rod 17 is filled with a pressurizing medium, preferably compressed air that is subjected to positive pressure. This causes the piston rod to extend so far that the cylinder sleeve 10 strikes against the stop before striking against the ring 12. The first chamber 20 is connected to a first supply and discharge line 21, by means of which the pressurizing medium can be supplied or discharged. A throttle 22 that ensures that the pressurizing medium flows only at a reduced velocity is installed in this supply and discharge line 21. Advantageously, the flow resistance formed by the throttle 22 can be adjusted by means of an adjusting device represented by the arrow 32. The open end 23 of the supply and discharge line 21 shown in FIG. 2 opens into the atmosphere.

When the cylinder sleeve 10 is now slid onto the cylinder mandrel 9, the former strikes against the stop 16, as a result of which the reciprocating piston is ultimately moved against the pressure prevailing in the first chamber 20 and the pressurizing medium is compressed further. Thus the kinetic energy of the cylinder sleeve 10 is absorbed and the latter is decelerated. In order to prevent the restoring force generated by the compressed pressurizing medium from increasing to an excessive level, the pressurizing medium can escape by way of the supply and discharge line 21 and the throttle 22, while a positive pressure persists in the first chamber or reduces in a delayed manner. It is thus possible by means of the arrangement suggested by the invention to decelerate the cylinder sleeve 10 on its travel up to the ring and at the same time allow the pressurizing medium to escape so that ultimately, when the cylinder sleeve 10 bears against the ring, there is no more restoring force acting on the cylinder sleeve in a direction extending opposite to the one represented by the arrow 11.

Figure 3:
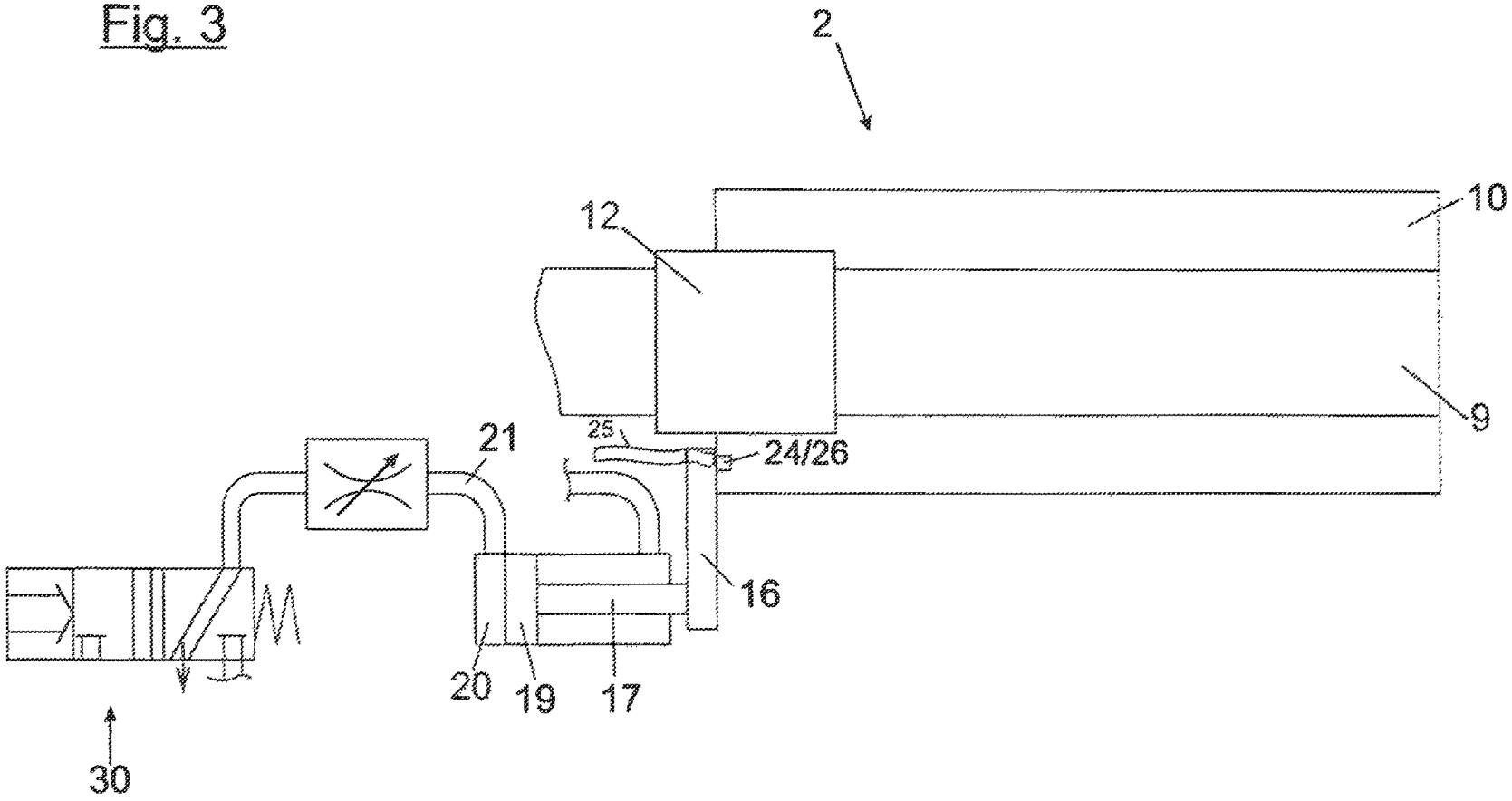
FIG. 3 corresponds to FIG. 2, but includes the cylinder sleeve that is slid on the print roller, FIG. 4 corresponds to FIG. 3, but shows the stop device that is removed from the cylinder sleeve, FIG. 5 corresponds to FIG. 4, but shows the stop device that is again set against the cylinder sleeve.

This situation is shown in FIG. 3. It is further evident from FIGS. 2 and 3 that the stop is provided with a compressed-air outlet 24, in which a compressed-air supply line 25 ends. When the cylinder sleeve 10 bears against the stop 16, this compressed-air outlet 24 engages in the compressed-air supply opening 26 so that compressed air can be applied to the cylinder sleeve 10. An additional sleeve can now be slid onto the cylinder sleeve 10, which can guide the compressed air by means of a compressed-air line system through openings on its outer circumference. This additional sleeve can in turn be slid easily onto the cylinder sleeve due to the resulting air cushion.

For printing purposes, the stop 16 must now be removed from the cylinder sleeve 10. For this purpose, a pressurizing medium that is subjected to positive pressure can easily be guided into the second chamber 28 by means of the second supply line 27 so that the reciprocating piston 19 and thus the stop 16 are again displaced in the direction of the arrow 11 until the compressed-air outlet is completely pulled out of the compressed-air supply opening 16 [sic: 26].

In FIG. 3, the first supply and discharge line does not open out into the ambience, but instead into a directional valve 30. The latter is switched in such a way for the purpose of sliding the cylinder sleeve 10 that the pressurizing medium can escape into an unpressurized region. If compressed air is used, the same is easily released into the ambience.

Figure 4:
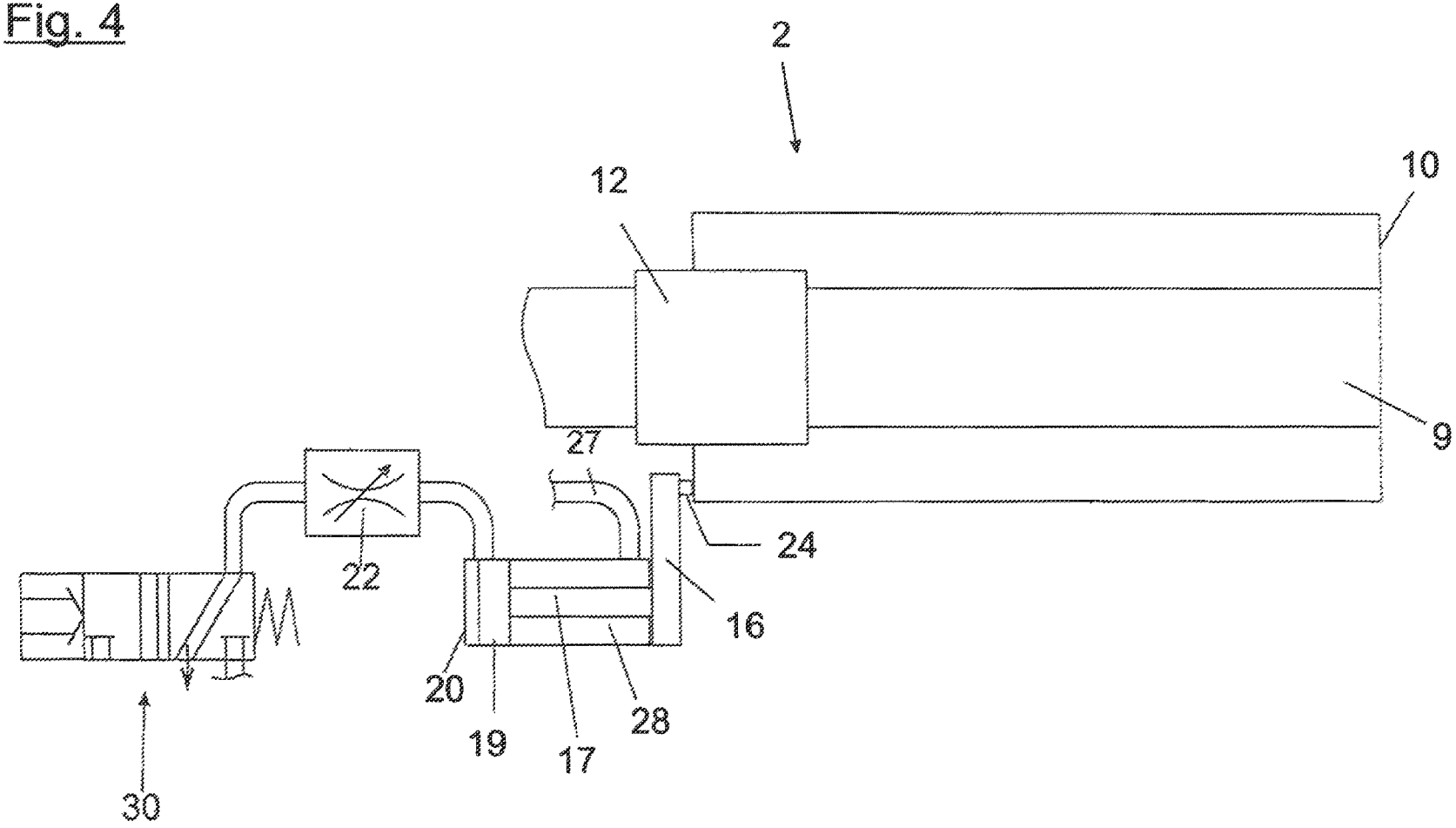
Figure 5:
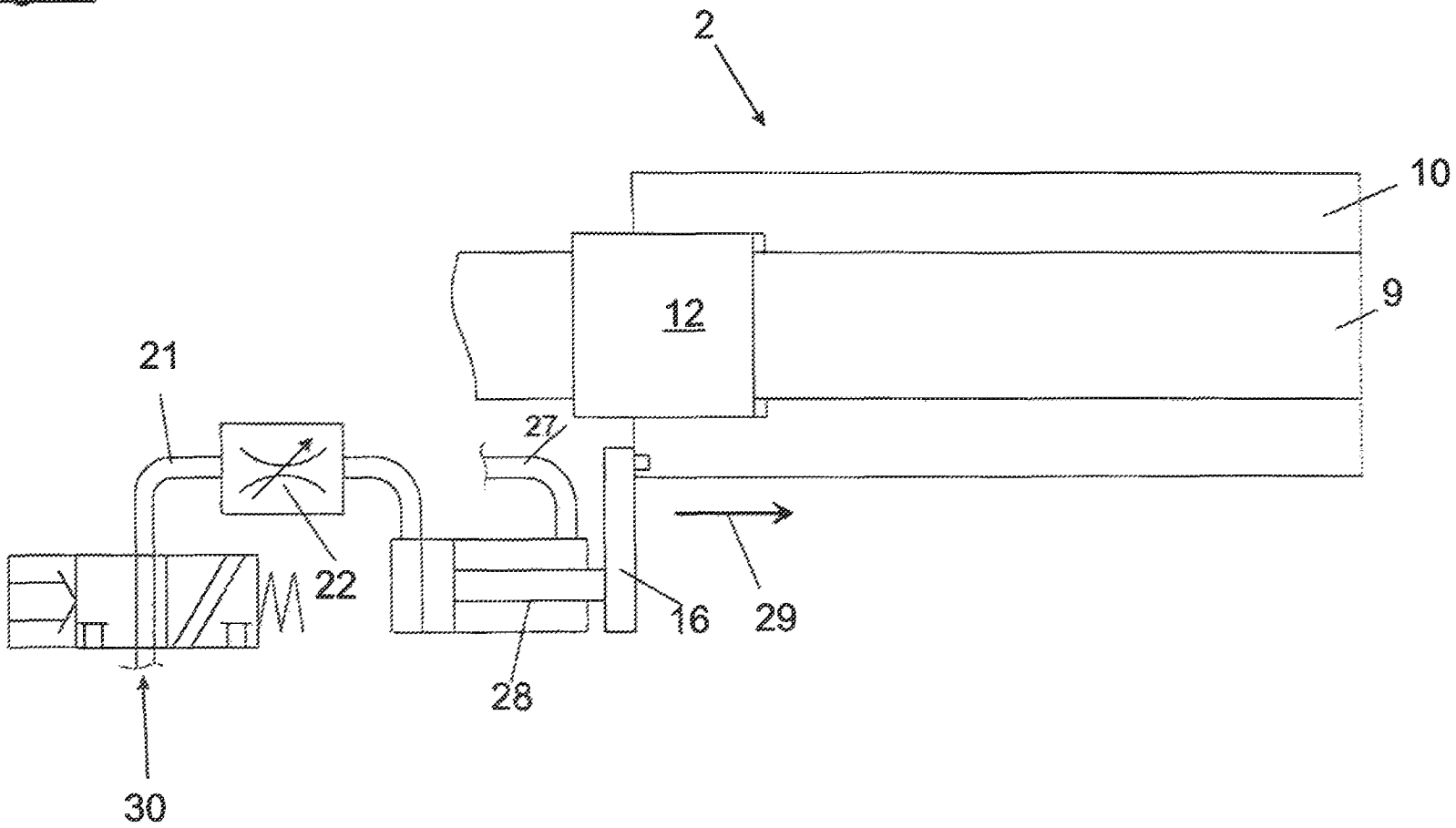

The directional valve can be switched, as shown in FIG. 4, for pulling off the cylinder sleeve 10. In this way, the supply and discharge line 21 can be connected to a positive-pressure source. The reciprocating piston 19 and thus the stop 16 now exert a force in the direction of the arrow 28 [sic: 29]. It is thus possible to simplify even the process of pulling off the cylinder sleeve, if required, since the stop 16 acts as the means to push off the cylinder sleeve.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numerals | |
|---|---|
| 1 | Inking system |
| 2 | Print roller |
| 3 | Anilox roller |
| 4 | Impression cylinder |
| 5 | Bearing block |
| 6 | Bearing block |
| 7 | Rail |
| 8 | Double arrow |
| 9 | Cylinder mandrel |
| 10 | Cylinder sleeve |
| 11 | Arrow |
| 12 | Ring |
| 13 | Section having an enlarged inside diameter |
| 14 | Front side of the ring |
| 15 | Stop device |
| 16 | Stop |
| 17 | Piston rod |
| 18 | Pressurizing-medium cylinder |
| 19 | Reciprocating piston |
| 20 | First chamber |
| 21 | First supply and discharge line |
| 22 | Throttle |
| 23 | Open end |
| 24 | Compressed-air outlet |
| 25 | Compressed-air supply line |
| 26 | Compressed-air supply opening |
| 27 | Second supply line |
| 28 | Second chamber |
| 29 | Arrow |
| 30 | Directional valve |
| 31 | Frame of printing press |
| 32 | Arrow (Adjusting device) |

What is claimed is:

1. An inking system of a printing press, comprising:

an impression cylinder for guiding a printing substrate;

an ink-transfer roller that includes a cylinder mandrel, on which a cylinder sleeve is concentrically displaceable, the cylinder sleeve having a compressed air supply opening therein, and a plurality of openings in a circumferential surface thereof that are in communication with the compressed air supply opening;

bearing blocks, in which corresponding ends of the ink-transfer roller are mountable and which are displaceable independently of each other relative to the impression cylinder so that the ink-transfer roller is positionable against the impression cylinder or any other ink-transfer roller, a bearing block being detachable from a first end of the ink-transfer roller and displaceable relative thereto so that the cylinder sleeve is mountable to and removable from the cylinder mandrel via the first end of the ink-transfer roller;

a cylinder sleeve stop barrier located on the cylinder mandrel at a second end of the ink-transfer roller; and a stop device that contacts the cylinder sleeve being mounted on the cylinder mandrel before the cylinder sleeve contacts the cylinder sleeve stop barrier, the stop device including (a) a controllably positionable stop element and a force-providing element, the stop element being (i) positionable so as to contact the cylinder sleeve being mounted and (ii) controllably decelerated by the force-providing element so as to bring the contacted cylinder sleeve to a controlled stop against the cylinder sleeve stop barrier, and (b) a compressed air supply line and a compressed air outlet that are integral to the controllably positionable stop element so as to travel with the stop element as it is positioned, the compressed air outlet being connectable to the compressed air supply opening of the cylinder sleeve to provide the compressed air to the plurality of openings in the circumferential surface thereof for the mounting of a second cylinder sleeve on the mounted and stopped cylinder sleeve.

2. The inking system according to claim 1, wherein the force-providing element is a pressurizing-medium cylinder that includes at least one pressure chamber that is subjectable to a positive or a negative pressure.

3. The inking system according to claim 2, where in the pressure chamber includes at least one of a supply line and a discharge line for at least one of supplying and discharging the pressurizing medium, and a throttle element provided in at least one of the supply line and the discharge line for reducing a flow velocity of the pressurizing medium within parts of at least one of the supply line and the discharge line.

4. The inking system according to claim 3, wherein the throttle element is adjustable such that the flow velocity of the pressurizing medium is controllable.

5. The inking system according to claim 2, wherein the stop device is placeable against a front side of the cylinder sleeve or removable therefrom via the pressurizing-medium cylinder.

6. The inking system according to claim 1, wherein the stop device contacts an interior end of the cylinder sleeve.

7. An inking system of a printing press, comprising:

an impression cylinder for guiding a printing substrate;

an ink-transfer roller that includes a cylinder mandrel and a cylinder sleeve displaceable thereon, the cylinder sleeve having a compressed air supply opening therein, and a plurality of openings in a circumferential surface thereof that are in communication with the compressed air supply opening;

a first and a second bearing block, in which a corresponding first and second end of the ink-transfer roller are mountable and which are displaceable independently of each other, the first bearing block being detachable from the first end of the ink-transfer roller and being displaceable relative thereto so that the cylinder sleeve is mountable to the cylinder mandrel in a first axial direction and removable from the cylinder mandrel in a second axial direction via the first end of the ink-transfer roller;

a cylinder sleeve stop barrier located on the cylinder mandrel at the second end of the ink-transfer roller; and a stop device that contacts the cylinder sleeve being mounted on the cylinder mandrel before the cylinder sleeve contacts the cylinder sleeve stop barrier, the stop device including (a) a controllably positionable stop element and a force-providing element, the stop element being (i) positionable by the force-providing element so as to contact the cylinder sleeve being mounted and (ii) controllably decelerable by the force-providing element so as to bring the contacted cylinder sleeve to a controlled stop against the cylinder sleeve stop barrier, and (b) a compressed air supply line and a compressed air outlet that are integral to the controllably positionable stop element so as to travel with the stop element as it is positioned, the compressed air outlet being connectable to the compressed air supply opening of the cylinder sleeve to provide the compressed air to the plurality of openings in the circumferential surface thereof for the mounting of a second cylinder sleeve on the mounted and stopped cylinder sleeve, and the force-providing element including a throttle element that controls flow of a force-providing medium so as to effect the controlled step of the cylinder sleeve.

8. The inking system according to claim 7, wherein the force-providing element is a pressurizing-medium cylinder that includes at least one pressure chamber that is subjected to a positive or a negative pressure, and wherein the throttle element reduces a flow velocity of a pressurizing medium.

9. The inking system according to claim 8, further comprising a directional valve associated with the pressurizing-medium cylinder, and wherein the stop device pushes the cylinder sleeve in the second axial direction for the removal of the cylinder sleeve from the cylinder mandrel.

10. The inking system according to claim 7, wherein the throttle element is adjustable such that a flow velocity of the force-providing medium is controllable.

11. An apparatus for controlling a position of a cylinder sleeve on an ink-transfer roller of an inking system, the inking system having a cylinder mandrel on which the cylinder sleeve is displaced concentrically, the cylinder sleeve having a compressed air supply opening therein, and a plurality of openings in a circumferential surface thereof that are in communication with the compressed air supply opening, bearing blocks in which ends of the ink-transfer roller are mounted and which are displaceable independently of each other in a radial direction of an impression cylinder so that the ink-transfer roller is placeable against the impression cylinder or any other ink-transfer roller, a bearing block detachable from one end of the ink-transfer roller and displaceable relative to the ink-transfer roller so that the cylinder sleeve can be removed by way of said one end, said apparatus comprising:

a device that brings the cylinder sleeve being mounted on the cylinder mandrel into contact with a stop device that includes a controllably movable stop element, with components of the stop device being movable in an axial directed of the ink-transfer roller, a force-providing element that controllably decelerates the movable components of the stop device to bring the cylinder sleeve to a controlled stop against a stop barrier on the cylinder mandrel, and a compressed air supply line and a compressed air outlet that are integral to the controllably movable stop element so as to travel with the stop element as it is moved, the compressed air outlet being connectable to the compressed air supply opening of the cylinder sleeve to provide the compressed air to the plurality of openings in the circumferential surface thereof for mounting of a second cylinder sleeve on the mounted and stopped cylinder sleeve.

* * * * *